US007601023B1

(12) United States Patent
Ma et al.

(10) Patent No.: US 7,601,023 B1
(45) Date of Patent: Oct. 13, 2009

(54) POWER ADAPTER

(75) Inventors: Jian Rong Ma, Tu-Cheng (TW); Shou Jun Du, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/222,317

(22) Filed: Aug. 7, 2008

(51) Int. Cl.
*H01R 29/00* (2006.01)

(52) U.S. Cl. ..... 439/518

(58) Field of Classification Search ..... 439/518, 439/171, 172, 173
See application file for complete search history.

(56) References Cited

U.S. PATENT DOCUMENTS 6,328,581 B1 * 12/2001 Lee et al. ..... 439/106
6,332,794 B1 * 12/2001 Tzeng Jeng ..... 439/188
6,592,386 B2 * 7/2003 Teng et al. ..... 439/172
6,793,499 B1 * 9/2004 Chen ..... 439/13
6,821,134 B2 * 11/2004 Chen ..... 439/131
6,845,023 B2 * 1/2005 Philips et al. ..... 363/132
6,942,508 B2 * 9/2005 Wong ..... 439/171
7,168,969 B1 * 1/2007 Wang ..... 439/173
7,273,384 B1 * 9/2007 So ..... 439/172
7,381,059 B2 * 6/2008 Wong ..... 439/22
7,381,067 B2 * 6/2008 Sze ..... 439/131
2004/0110413 A1 * 6/2004 Brandstatter et al. ..... 439/518

* cited by examiner

*Primary Examiner*—T C Patel
*Assistant Examiner*—Vladimir Imas
(74) *Attorney, Agent, or Firm*—Rosenberg, Klein & Lee

(57) ABSTRACT

A power adapter has a main body. A top of the main body defines a recess and an annular sidewall enclosing the recess. The annular sidewall has a sliding recess extending along the circumference of an inner surface thereof. A rotation-proof component defines a rotation-proof portion received in the sliding recess. A plug rotatably and detachably mounted to the main body defines a protruding portion at one side thereof. The protruding portion is capable of reciprocally sliding in the sliding recess and elastically pressing the rotation-proof portion for passing through the rotation-proof portion and then being restrained from reverse rotation because of restoration of the rotation-proof portion.

5 Claims, 5 Drawing Sheets

POWER ADAPTER

BACKGROUND OF THE INVENTION

1. Field of the Invention

The present invention relates to a power adapter, and more particularly to a power adapter having a structure which is convenient to assemble and disassemble a plug with a main body thereof and which occupies a relatively small space.

2. The Related Art

Generally, a power adapter is always used for adapting different sockets provided in different countries when one traveling all over the world. Therefore, a plug of the power adapter for connecting with the socket also must be exchangeable for adapting different sockets. The power adapter generally includes a main body and a plug mounted to the main body. The main body has an opening; a side of the plug has an arm with a -protruding portion located on an end thereof away from the main body. A guiding recess in the main body can receive both the arm and the protruding portion so that the protruding portion is wedged into the opening for preventing the plug from reverse rotation.

However, such engaging structure needs to press the protruding portion in assembly and disassembly, which is quite inconvenient for user to assemble and disassemble the plug. Furthermore, such engaging structure occupies such big a space that the volume of the power adapter is increased, which can not meet people's requirement of miniaturization and light-weighting. In addition, it is also inconvenient for user to carry the power adapter in traveling. So a power adapter having an engaging structure which is convenient to assemble and disassemble a plug with a main body thereof and which occupies a relatively small space is required.

SUMMARY OF THE INVENTION

Accordingly, an object of the present invention is to provide a power adapter having a structure which is convenient to assemble and disassemble a plug with a main body thereof and which occupies a small space. A top of the main body defines a recess and an annular sidewall enclosing the recess. The annular sidewall has a sliding recess extending along the circumference of an inner surface thereof. A rotation-proof component defines a rotation-proof portion received in the sliding recess. A plug rotatably and detachably mounted to the main body defines a protruding portion at a side thereof. The protruding portion is capable of reciprocatingly sliding in the sliding recess and elastically pressing the rotation-proof portion for passing through the rotation-proof portion and then being restrained from reverse rotation because of restoration of the rotation-proof portion.

As described above, the plug is assembled to an end of the main body, and the rotation-proof portion is received in the sliding recess. When the plug is rotated with respect to the main body, the protruding portion presses elastically the rotation-proof portion and slides through the rotation-proof portion, and then, the rotation-proof portion restores its elasticity and abuts against the protruding portion for preventing the plug from reverse rotation. When the plug needs to disengage from the main body, a reverse force is applied to the plug so that the protruding portion elastically presses the rotation-proof portion and slides back in initial way. Such structure simplifies the process of assembly and disassembly of the plug with the main body and is more convenient to assemble and disassemble. Furthermore, such structure occupies a relatively small space so as to be capable of reducing weight and volume of the power adapter.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
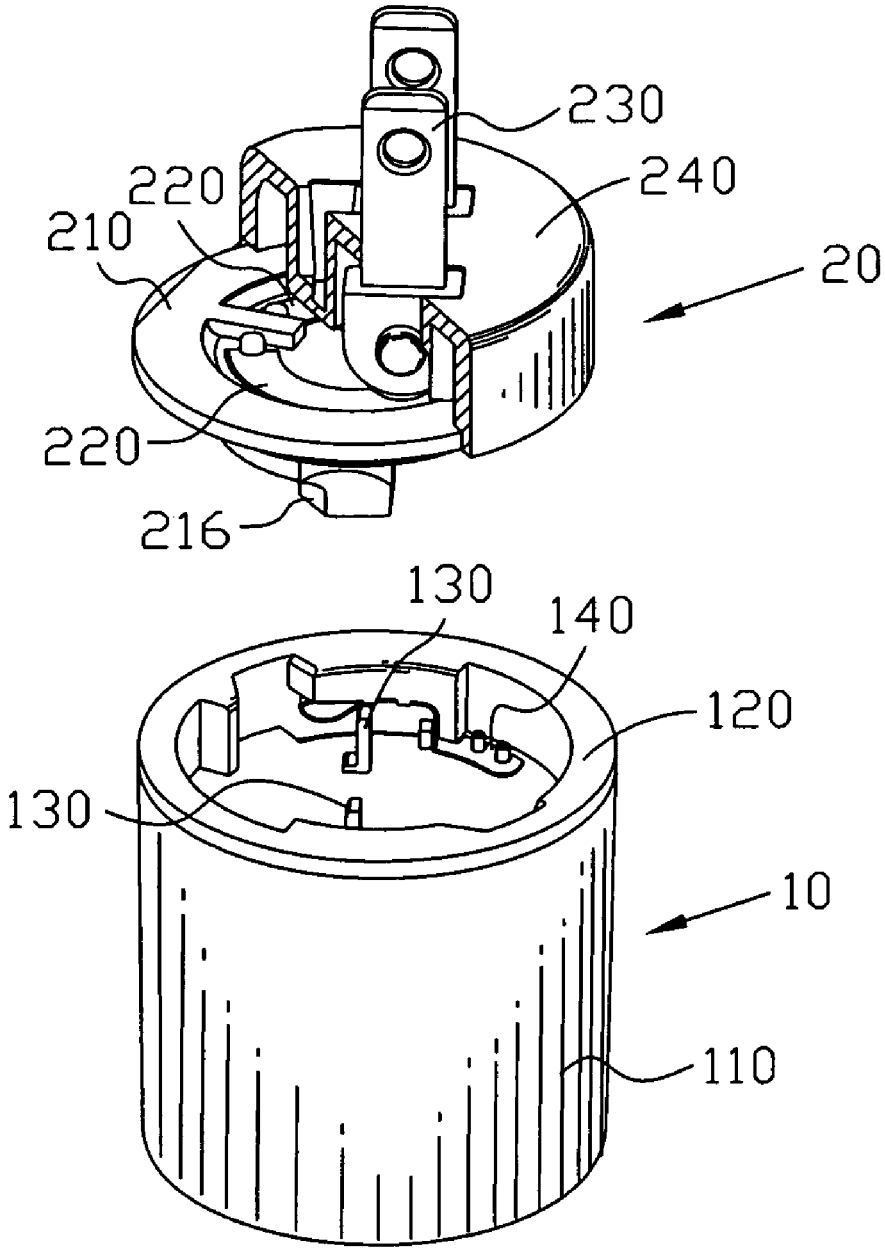
FIG. 1 is a schematic view showing a power adapter in an embodiment according to the present invention, wherein a plug of the power adapter is shown in a manner of cross-sectional view.

With reference to FIG. 1, a power adapter includes a case 10 and a plug 20 engaged with the case 10. The case 10 has a main shell 110, a main body 120 mounted in the main shell 110 and a plurality of main terminals 130 received in the main body 120.

Figure 2:
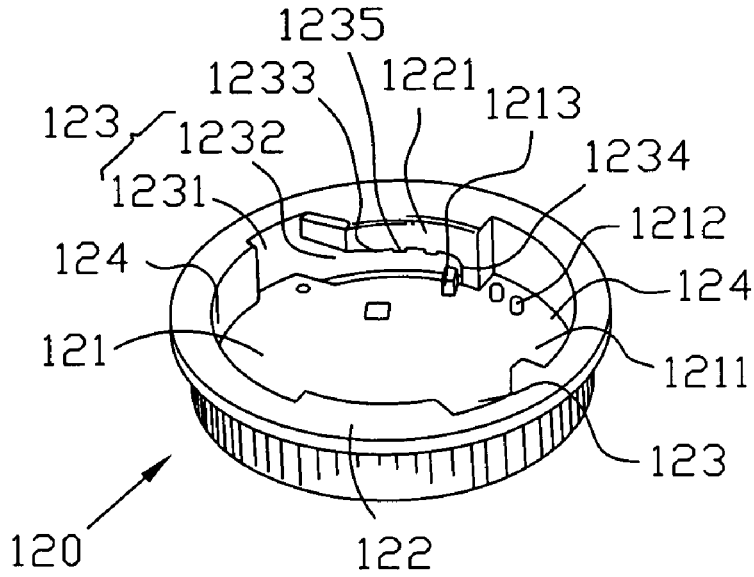
FIG. 2 is a perspective view of a main body of the power adapter shown in FIG. 1 while seen from a top view.

Please refer to FIG. 1 and FIG. 2, the main body 120 is of a cylindrical shape and defines a recess 121 with a bottom surface 1211 defined therein and an annular sidewall 122 enclosing the recess 121. The annular sidewall 122 defines an annular inner surface 1221; the inner surface 1221 is recessed inward to form two fixing recesses 123 and two receiving recesses 124, respectively and symmetrically. The fixing recess 123 includes a guiding recess 1231 extending upward and downward and passing through a top of the annular sidewall 122, and a sliding recess 1232 communicating with the guiding recess 1231. The sliding recess 1232 extends along the circumferential direction of the annular sidewall 122 and is adjacent to the bottom surface 1211. The sliding recess 1232 defines an upper side 1233 and a closed end 1234 adjacent to the receiving recess 124. The upper side 1233 protrudes axially to form two protrusions 1235. The protrusion 1235 is disposed to be adjacent to the inner surface 1221. The bottom surface 1211 extends upward to form a restricting portion 1212 and a blocking portion 1213. The restricting portion 1212 is located in the receiving recess 124 and near the closed end 1234 of the sliding recess 1232. The blocking portion 1213 is spaced away from the closed end 1234 a short distance. The main terminals 130 are mounted to the bottom surface 1211.

Figure 3:
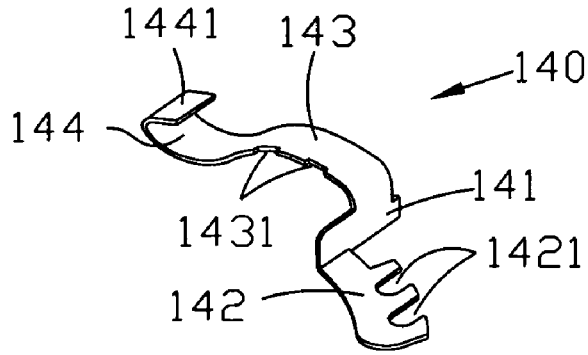
FIG. 3 is a perspective view of a rotation-proof component of the power adapter shown in FIG. 1 while seen from a top and side view.

Please refer to FIG. 1 and FIG. 3, the case 10 further has a rotation-proof component 140 disposed in the fixing recess 123 and defining a connecting plate 141. The connecting plate 141 is of a rectangular shape. One side of the connecting plate 141 bends and extends to form a fixing portion 142. The fixing portion 142 has at least one mating opening 1421 corresponding to the restricting portion 1212 at the bottom surface 1211. The other side of the connecting plate 141 extends upwardly and obliquely and then bends downward to form an extending portion 143 of an arc shape. The extending portion 143 and the fixing portion 142 are arranged at two opposite sides of the connecting plate 141 unsymmetrically. A side of the extending portion 143 has two buckling notches 1431 corresponding to the protrusions 1235. A free end of the extending portion 143 extends downward and bends upward to form a rotation-proof portion 144. The rotation-proof portion 144 extends to show an arc shape opposite to the extending portion 143. A free end of the rotation-proof portion 144 bends upward to form a buckling end 1441 with a sharp angle formed therebetween for elastically abutting the upper side 1233 of the sliding recess 1232.

In assembly, the fixing portion 142 is located at the bottom surface 1211 and partly received in the receiving recess 124, and the mating opening 1421 has the restricting portion 1212 restricted therein for preventing the fixing portion 142 from moving radially and outwardly. The connecting plate 141 is disposed between the closed end 1234 and the blocking portion 1213 for fixing the rotation-proof component 140 in place. The extending portion 143 and the rotation-proof portion 144 are both received in the sliding recess 1232; the extending portion 143 is adapted for cooperating with the rotation-proof portion 144 to restrain the protruding portion 216 from reverse rotation and attached to the upper side 1233; and the buckling notches 1431 engage with the protrusions 1235 for preventing the extending portion 143 from moving inwardly. The buckling end 1441 is forcefully pressed against the upper side 1233 for reducing the elastic deformation of the rotation-proof portion 144.

Figure 4:
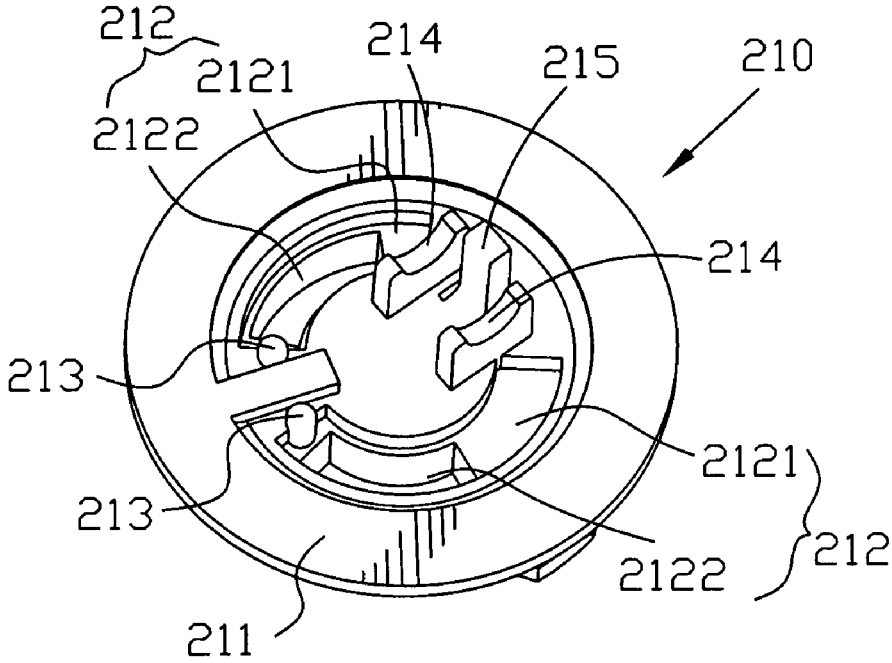
FIG. 4 is a perspective view of a plug body of the power adapter shown in FIG. 1 while seen from a top view.

Please refer to FIG. 1 and FIG. 4, the plug 20 includes a plug body 210, two conducting terminals 220 and two connecting terminals 230 and a cover 240. The plug body 210 is of a disc shape and defines a top surface 211. The top surface 211 has two conducting recesses 212 defined therein to receive the conducting terminals 220. The conducting recess 212 includes a first cavity 2121 and a second cavity 2122 extending downward to pass through the plug body 210 from a bottom surface of the first cavity 2121. The first cavity 2121 is of a fan shape. The second cavity 2122 of also a fan shape is disposed near one end of the first cavity 2121 and narrower than the first cavity 2121. The end of the bottom surface of the first cavity 2121 extends upward to form a positioning portion 213 adjacent to an end of the second cavity 2122. The positioning portion 213 is used to position the conducting terminal 220. In this embodiment, the positioning portion 213 is of a short-pillar shape. The plug body 210 further has a pair of supporting portions 214 adjacent to the other end of the first cavity 2121. A top portion of the supporting portion 214 is of an arc shape. A stopping portion 215 extends upward from the top surface 211 and is disposed between the two supporting portions 214. A bottom of the plug body 210 extends outward to form a protruding portion 216 corresponding to the fixing recess 123.

Figure 5:
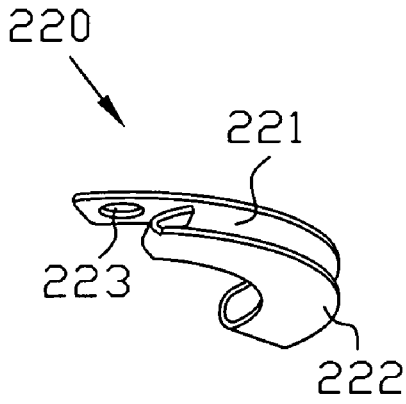
FIG. 5 is a perspective view of a conducting terminal of the power adapter shown in FIG. 1 while seen from a bottom and side view.

Please refer to FIG. 1 and FIG. 5, the conducting terminal 220 received in the conducting recess 212 defines a first contacting plate 221 received in the first cavity 2121 for electrically connecting with the main terminal 130. The first contacting plate 221 is of a fan shape. One end of the first contacting plate 221 bends downward and extends to form a second contacting plate 222 overlapping the first contacting plate 221. The second contacting plate 222 is similar in shape to the first contacting plate 221 and spaced away from the first contacting plate 221 with a certain distance. The second contacting plate 222 is shorter than the first contacting plate 221 and bends upward to contact the first contacting plate 221. The other end of the basic plate 221 has a positioning hole 223 defined therein to mate with the positioning portion 213 for positioning the conducting terminal 220 in the conducting recess 212.

Figure 6:
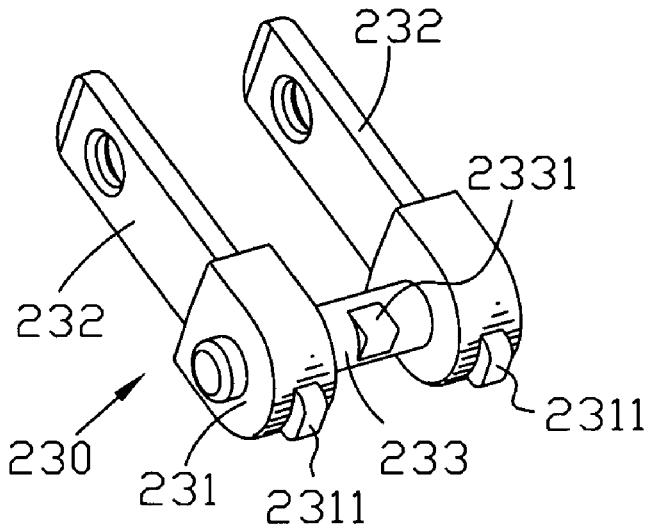
FIG. 6 is a perspective view of a connecting terminal of the power adapter shown in FIG. 1 while seen from a bottom and side view.

Please refer to FIG. 1 and FIG. 6, the connecting terminal 230 located on the plug body 210 defines a base 231. One end of the base 231, which is of an arc shape, has a contacting portion 2311 used for electrically connecting with the second contacting plate 222. The other end of the base 231 is assembled with a connecting portion 232 for electrically connecting with a socket (not shown). In this embodiment, there are two bases 231 connected together by a linking portion 233. The linking portion 233 is of a column shape. A side of the linking portion 233 has a bump 2331 corresponding to the stopping portion 215 for preventing the connecting terminal 230 from rotation.

Figure 7:
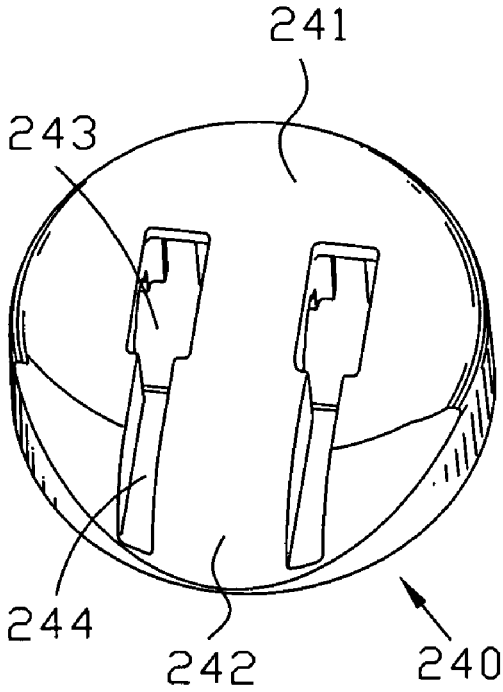
FIG. 7 is a perspective view of a cover of the power adapter shown in FIG. 1 while seen from a top view.
Figure 8:
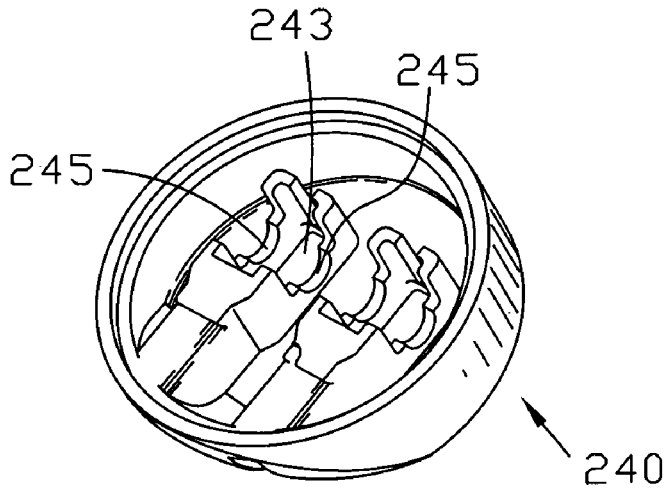
FIG. 8 is a perspective view of the cover of the power adapter shown in FIG. 7 while seen from a bottom and side view.
Figure 9:
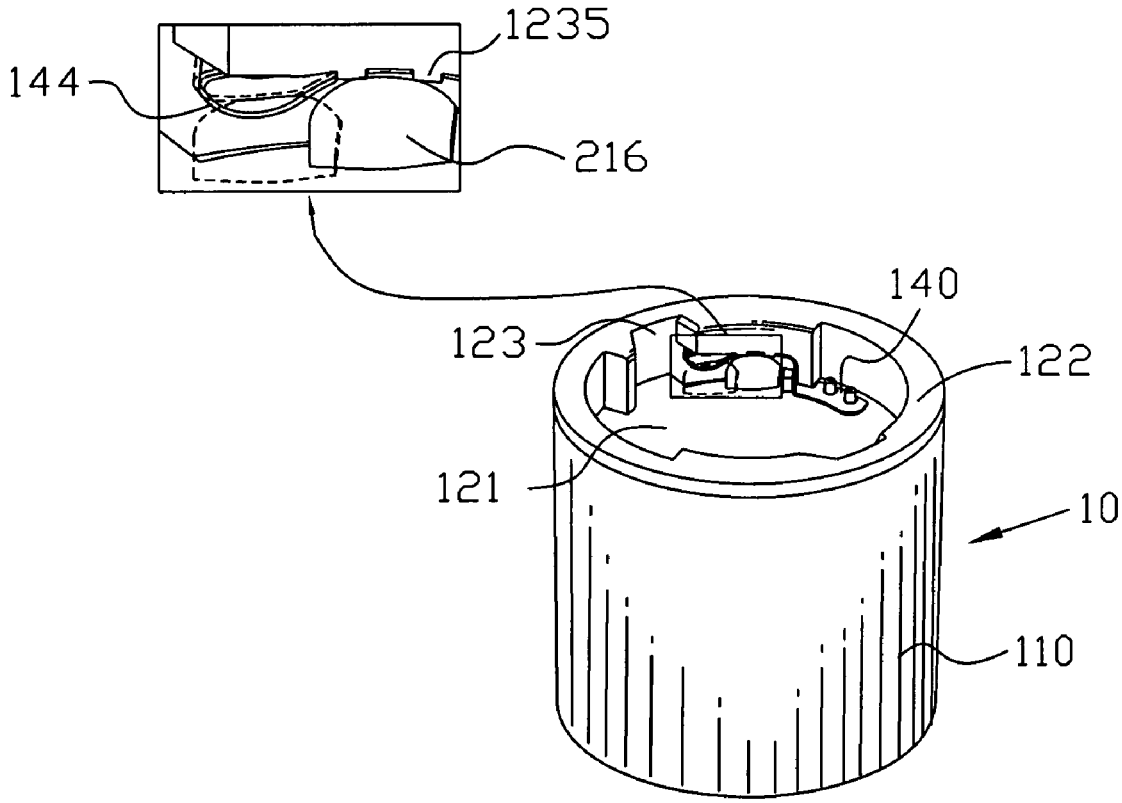
FIG. 9 is a schematic view illustrating the state of a rotation-proof portion when a protruding portion slides in a sliding recess.

Please refer to FIG. 1 and FIGS. 7-8, the cover 240 coupled with the plug body 210 defines an upper surface 241 and a gradient surface 242 connected with the upper surface 241. The upper surface 241 has two connecting slits 243 corresponding to the connecting portion 232 for allowing the connecting portion 232 passing therethrough. Each of the connecting slits 243 extends toward the gradient surface 242 to form a holding recess 244. The holding recess 244 passes through the gradient surface 242 and is used to receive the connecting portion 232 when the power adapter is not in use. The upper surface 241 extends downward to form a mating portion 245. The mating portions 245 are arranged at two sides of the connecting slit 243 for coupling with the linking portion 233.

Please refer to FIGS. 1-3 and FIG. 9, when the user wants to assemble the case 10 and the plug 20, firstly, the plug 20 has to be adjusted to be in a first position, where the protruding portions 216 are respectively wedged into the guiding recesses 1231. Then the user can clockwise rotate the plug 20 an angle with respect to the case 10 so that the plug 20 will be fixed in the case 10. In this process, the protruding portion 216 presses the rotation-proof portion 144 upward so that the rotation-proof portion 144 deforms elastically, and then the protruding portion 216 slides through the rotation-proof portion 144. Then the rotation-proof portion 144 restores its elasticity so as to abut against the protruding portion 216 for restraining reverse rotation thereof. Thus the plug 20 can be mounted to the case 10 steadily. When the plug 20 needs to take away from the case 10, a counterclockwise force is applied to the plug 20 such that the rotation-proof portion 144 is elastically pressed back; the protruding portion 216 slides back to the first position in initial way so that the plug 20 disengages from the case 10.

As described above, the plug 20 is assembled to an end of the main body 120, and the rotation-proof portion 144 is received in the sliding recess 1232 of the annular sidewall 122. When the plug 20 is rotated with respect to the case 10, the protruding portion 216 elastically presses the rotation-proof portion 144 upward and then slides through the rotation-proof portion 144. After that, the rotation-proof portion 144 restores its elasticity and abuts against the protruding portion 216 for preventing the plug 20 from reverse rotation. When the plug 20 needs to disengage from the case 10, a counterclockwise force is applied to the plug 20 so that the protruding portion 216 slides back in initial way. Such structure simplifies the process of assembly and disassembly of the plug 20 with the case 10 and is more convenient to assemble and disassemble. Furthermore, such structure occupies a relatively small space so as to be capable of reducing weight and volume of the power adapter.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A power adapter, comprising:

a main body, a top of the main body defining a recess and an annular sidewall enclosing the recess, the annular sidewall having a sliding recess extending along the circumference of an inner surface thereof;

a rotation-proof component defining a rotation-proof portion received in the sliding recess, the rotation-proof component defining an extending portion of substantially arc shape, the rotation-proof portion extending from a free end of the extending portion to show an arc shape substantially opposite to the extending portion; and a plug rotatably and detachably mounted to the main body, the plug having a protruding portion at one side thereof, the protruding portion being capable of reciprocally sliding in the sliding recess and elastically pressing the rotation-proof portion for passing through the rotation-proof portion and then being restrained from reverse rotation, the extending portion being adapted to cover the protruding portion for cooperating with the rotation-proof portion to restrain the protruding portion from reverse rotation.

2. The power adapter as claimed in claim 1, wherein a free end of the rotation-proof portion bends toward the extending portion to form a buckling end which is urged against an upper side of the sliding recess for reducing the elastic deformation of the rotation-proof portion.

3. The power adapter as claimed in claim 1, wherein the upper side of the sliding recess has a protrusion, the extending portion is attached to the upper side of the sliding recess and has a buckling notch engaging with the protrusion for fixing the rotation-proof component.

4. The power adapter as claimed in claim 1, wherein the rotation-proof component further includes a connecting plate connecting with the extending portion, a bottom surface of the recess has a blocking portion spaced from an closed end of the sliding recess with a short distance, the connecting plate is disposed between the blocking portion and the closed end of the sliding recess for fixing the rotation-proof component.

5. The power adapter as claimed in claim 4, wherein the bottom surface of the recess has a restricting portion, the connecting plate connects with a fixing portion, the fixing portion has a mating opening coupling with the restricting portion for fixing the rotation-proof component.

* * * * *